US008872753B2

(12) United States Patent
Glen

(10) Patent No.: US 8,872,753 B2
(45) Date of Patent: Oct. 28, 2014

(54) ADJUSTING BRIGHTNESS OF A DISPLAY IMAGE IN A DISPLAY HAVING AN ADJUSTABLE INTENSITY LIGHT SOURCE

(75) Inventor: David I. J. Glen, Toronto (CA)

(73) Assignee: ATI Technologies ULC, Markham, Ontario (CA)

( * ) Notice: Subject to any disclaimer, the term of this patent is extended or adjusted under 35 U.S.C. 154(b) by 2430 days.

(21) Appl. No.: 11/469,232

(22) Filed: Aug. 31, 2006

(65) Prior Publication Data

US 2008/0055228 A1 Mar. 6, 2008

(51) Int. Cl.

| | |
|---|---|
| ***G09G 3/36*** | (2006.01) |
| ***G09G 3/34*** | (2006.01) |
| ***G09G 5/10*** | (2006.01) |
| *G09G 5/36* | (2006.01) |
| *G09G 5/14* | (2006.01) |

(52) U.S. Cl.

CPC ..... *G09G 5/10* (2013.01); *G09G 3/3406* (2013.01); *G09G 2320/0646* (2013.01); *G09G 3/342* (2013.01); *G09G 5/363* (2013.01); *G09G 2320/062* (2013.01); *G09G 2320/0633* (2013.01); *G09G 2370/047* (2013.01); *G09G 2360/144* (2013.01); *G09G 5/14* (2013.01)

USPC ..... 345/102; 345/69; 345/690

(58) Field of Classification Search

USPC ..... 345/69, 102, 690

See application file for complete search history.

(56) References Cited

U.S. PATENT DOCUMENTS

| | | | | |
|---|---|---|---|---|
| 6,801,811 | B2 | 10/2004 | Ranganathan | |
| 2002/0145041 | A1 * | 10/2002 | Muthu et al. | 235/454 |
| 2004/0104886 | A1 * | 6/2004 | Kawano | 345/102 |
| 2004/0252115 | A1 | 12/2004 | Boireau | |
| 2005/0068311 | A1 | 3/2005 | Fletcher et al. | |
| 2005/0146654 | A1 * | 7/2005 | Tseng | 349/69 |
| 2005/0212825 | A1 * | 9/2005 | Lee et al. | 345/690 |
| 2006/0033744 | A1 | 2/2006 | Perez | |
| 2006/0146056 | A1 | 7/2006 | Wyatt | |
| 2006/0181503 | A1 * | 8/2006 | Feng | 345/102 |
| 2006/0221260 | A1 * | 10/2006 | Fujine et al. | 348/790 |
| 2006/0282850 | A1 * | 12/2006 | Kim | 725/38 |
| 2007/0139354 | A1 * | 6/2007 | Kim et al. | 345/102 |

* cited by examiner

*Primary Examiner* — Premal Patel

(74) *Attorney, Agent, or Firm* — Faegre Baker Daniels LLP

(57) ABSTRACT

To adjust brightness of at least a portion of a display image, a type of content to be included within the display image is determined and, based on the identified content type, the light source of the display is set to an adjusted intensity. Thereafter, that portion of the display image unrelated to the content requiring adjusted brightness is processed to account for the adjusted intensity of the light source. Because the processing in accordance with the present invention is performed entirely on one or more processors that provide the display images to the display, the present invention overcomes the added complexity and cost associated with prior art techniques, while simultaneously providing the flexibility to quickly adjust display brightness based on types of content being included in the displayed image.

18 Claims, 4 Drawing Sheets

- PRIOR ART -

ADJUSTING BRIGHTNESS OF A DISPLAY IMAGE IN A DISPLAY HAVING AN ADJUSTABLE INTENSITY LIGHT SOURCE

FIELD OF THE INVENTION

The present invention relates generally to providing content to display devices and, in particular, to techniques for adjusting brightness of display images based on the types of content to be displayed.

BACKGROUND OF THE INVENTION

It is well-known in the area of computer technology that computer displays used by computers are relatively dim in terms of their luminance or brightness. Conversely, televisions typically comprise relatively bright displays. For example, a typical computer display has a luminance of approximately 50-300 nits (where 1 nit=1 candela/meter$^2$) whereas modern television displays are known to provide luminance of 500 nits or more.

Being aware of this distinction between display types, providers of content (e.g., multimedia data such as audio, graphics, still images or video) for each type of device typically author the content with these display limitations in mind. Thus, for example, video content is created so as to be best viewed on relatively bright displays. On the other hand, computer graphics are authored for relatively low level displays. However, when computer graphics are instead provided on a television display, they often appear too bright. Likewise, when content authored for a television display is instead displayed on a computer monitor, the resulting presentation is typically too dark for ideal viewing. This latter problem is compounded in those situations where video is provided on a computer display against a backdrop of other content that is otherwise intended to be displayed on a computer monitor. This is shown in FIG. 1, which illustrates an exemplary display image 104 on a display 102 in accordance with prior art techniques. In particular, FIG. 1 illustrates a display of a document D1 and an application A1 that, for purposes of this example, are assumed to be authored for viewing via a (relatively dim) computer display. In this situation, the document D1 and the application A1 will be displayed under optimal viewing conditions. However, the subsequent addition of a second application A2, comprising video or other content normally intended for viewing via a brighter display screen, will likely result in the video content of the application A2 being perceived as too dim, which problem is only exacerbated by the background presence of the document D1 and application A1. With increased opportunities to render traditionally separate types of content (such as video and computer graphics) on a single screen, these disparities are more likely to lead to negative user experiences.

It is known in the art to provide brightness, contrast, white level, backlight or other controls of the luminous output on various types of displays (hereafter referred to as brightness controls). However, users are unlikely to switch brightness levels using such controls as they move between different applications on a computer. Furthermore, such controls do not provide the ability to mix brightness levels within a single displayed image. In this same vein, various types of displays with adjustable backlight levels may be controlled to adjust the overall brightness of the display screen. Once again, these are typically restricted to controlling the overall brightness of the entire screen, and typically do not provide separate control over portions of the screen. Likewise, adjustments to these backlight levels are typically provided based on changes in power state of the device or explicit user input.

More recently, developers of liquid crystal display (LCD) technology have developed techniques that allow the displays themselves to adjust the brightness of certain regions within the display based on knowledge about the inputs being provided to the display. For example, such systems take advantage of techniques such as so-called "picture in picture" (PIP) which provide the monitor with data regarding where video content is to be displayed. In this manner, the display can adjust intensity of a backlight to be optimally bright for the video display, and thereafter adjust presentation of other regions on the screen to accommodate the adjusted intensity of the backlight. In a similar vein, such monitors may be provided with controls that allow the user to define a region on the display that is thereafter controlled in a similar manner. Not only do these solutions increase the cost and complexity of such displays, they are relatively limited in their ability to adapt to changes in content as they are displayed.

It would therefore be advantageous to provide a technique that allows for the flexible adjustment of brightness of portions of a display image based on content types without adding to the cost or complexity of displays.

BRIEF DESCRIPTION OF THE DRAWINGS

The features of the present invention are set forth with particularity in the appended claims. The invention itself, together with further features and attendant advantages, will become apparent from consideration of the following detailed description, taken in conjunction with the accompanying drawings. One or more embodiments of the present invention is now described by way of example only, with reference to the accompanying drawings wherein like referenced numerals represent like elements and in which:

DETAILED DESCRIPTION OF THE PRESENT EMBODIMENTS

Briefly, the present invention provides a technique for adjusting brightness of at least a portion of a display image in a system comprising a display having adjustable light source intensity. In one embodiment of the present invention, this is achieved by first determining a type of content to be included within the display image and, based on the identified content type, setting the intensity of the light source of the display to an adjusted intensity. Thereafter, the display image comprising the content is provided to the display. In one aspect of the present invention, the determination of the adjusted intensity of the particular content type is based on a plurality of intensity settings and corresponding plurality of content types that may be provided either by the display itself or otherwise acquired, e.g., from a host processor where they are prestored for access by the processor, or provided as user inputs to the host processor for later storage. Regardless, in a presently preferred embodiment, processing in accordance with the present invention includes determining a region of the displayed image corresponding to the content requiring the adjusted brightness and thereby defining a remaining portion of the display image. Once the light source of the display has been adjusted to accommodate the brightness requirements of the content, the remaining portion of the display image may be processed to accommodate the adjusted intensity of the display. Because the processing in accordance with the present invention is performed entirely on one or more processors that provide the display images to the display, the present invention overcomes the added complexity and cost associated with prior art techniques, while simultaneously providing the flexibility to quickly adjust display brightness based on types of content being included in the displayed image.

Figure 1:
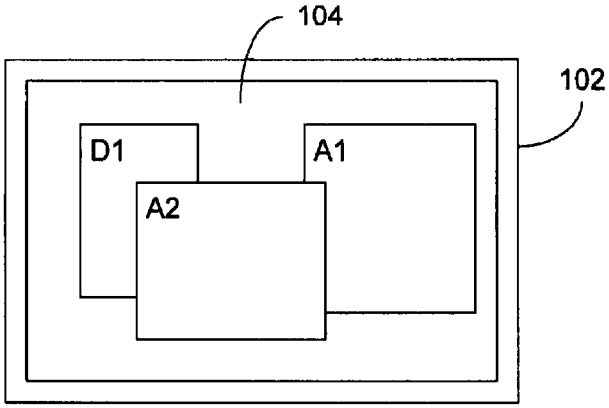
FIG. 1 is an illustration of a display image on a display in accordance with prior art techniques.
Figure 2:
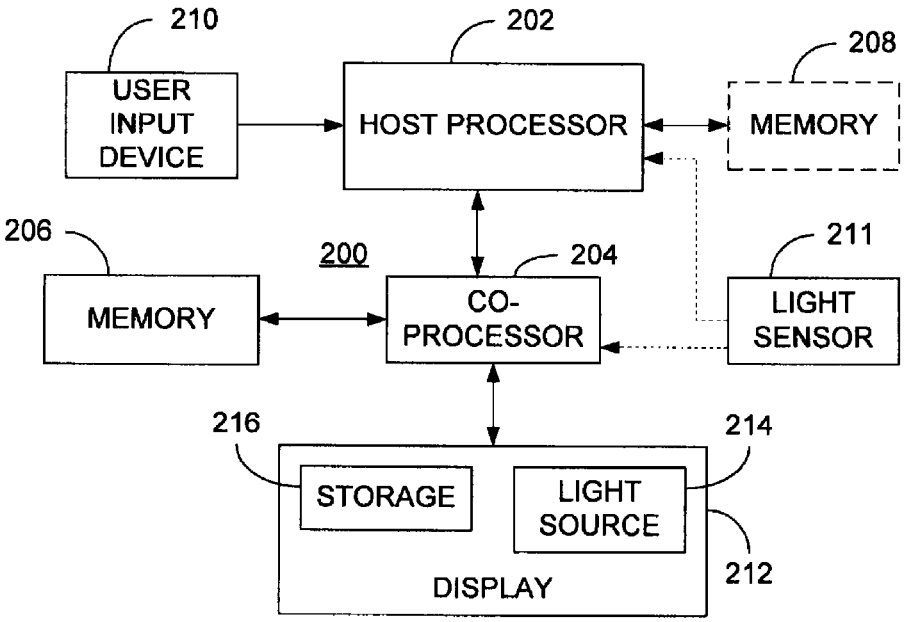
FIG. 2 is a schematic block diagram of a device in accordance with the present invention.

Referring now to FIG. 2, a device 200 is illustrated comprising a host or application processor 202 in communication with a co-processor 204 that, in turn, is in communication with a display 212. It should be noted that the embodiment of the device 200 illustrated in FIG. 2 is but one of many examples of the plurality of possible embodiments known to those having ordinary skill in the art. Generally, the device 200 may comprise any device that would benefit from a processor/co-processor arrangement, including devices that incorporate an embedded display or use an external display, such as, but not limited to, computers, printers, portable wireless communication devices, personal digital assistants, etc.

The host processor 202, as known in the art, may comprise any device capable of executing stored instructions and operating upon stored data such as a microcontroller, a microprocessor, a digital signal processor, or combinations thereof. Generally, the host processor 202 controls overall operation of the device 200. In a similar vein, the co-processor 204 may comprise any one or combination of such processors, or one or more suitably configured programmable logic arrays, or an application specific integrated circuit (ASIC). In the presently preferred embodiment, the co-processor 204 comprises a graphics processor such as a discrete or integrated graphics processor, or mobile phone or digital television image processors such as manufactured by ATI Technologies Inc.

As illustrated, the co-processor 204 may have associated therewith one or more memory devices 206 that may be used for the storage of executable obstructions for controlling operation of, and/or for the storage of data for operation upon by, the co-processor 204. Such devices 206 may comprise volatile memory, such as random access memory (RAM) or non-volatile memory, such as read-only memory (ROM), or combinations thereof. In a similar vein, the host processor 202 may likewise have at least one memory device 208 (of similar types to those described above) in communication therewith and similarly capable of storing executable instructions and/or operational data. In one aspect of the present invention, the memory devices 206, 208 may be used to store executable instructions for implementing processing in accordance with the present invention as described in further detail below.

One or more user input devices 210 are also provided in communication with the host processor 202. For example, the user input devices 210 may comprise any mechanism that allows the user of the device 200 to provide input to the host processor 202, such as keyboard, a pointer device such as a mouse, a voice recognition interface, etc.

A display 212 is provided, preferably in communication with the co-processor 204, for display of display images rendered by either the host processor 202 or co-processor 204. In accordance with the present invention, the display 212 may comprise any display having adjustable light source 214 intensity that is controllable by the co-processor 204 (or host processor 202 as the case may be). Furthermore, such displays may employ either transmissive (i.e., elements that impart image information on externally supplied light passing therethrough) or emissive (i.e., elements that serve as the sources of light and that directly impart image information on the emitted light) technologies. For example, in a transmissive display, such as a liquid crystal display (LCD), light source intensity may be controlled through adjustment of a backlight that supplies light to all of the transmissive elements. In an emissive display, such as a plasma display or a cathode ray tube (CRT), light source intensity is controlled at the level of each element, i.e., by adjusting the level of signal drive (e.g. voltage) to the light emissive picture elements. As used herein, a light source may comprise either type of light source associated with transmissive and emissive displays. In a presently preferred embodiment, the display 212 also comprises a storage device 216 that may be used to store parameters useful in implementing the present invention. For example, the storage device 216 may comprise a so-called "extended display identification data structure" (EDID) as known in the art. Typically, the storage device 216 will comprise a programmable read-only memory (PROM) or an electrically erasable PROM (EEPROM), although other types of storage devices, as described above, may be equally employed.

Finally, a light sensor 211 may be provided in communication with the host processor 202 and/or co-processor 204 and used to detect ambient light in the area of the display 212, i.e., a viewing environment of the display, and provide ambient light data to one or both of the processors 202, 204. As such, it is preferred to deploy the lights sensor 211 on or in the immediate vicinity of the display 212, although other locations may be employed as a matter of design choice. Light sensors for this purpose are well known in the art and may be selected to detect any of a number of characteristics regarding the ambient light, such as intensity, color composition, etc. As known in the art, knowledge of the ambient light (via the ambient light data) can be used to determine optimal display intensity (or other parameters, e.g., color hue/tint, etc.) as described in further detail below. For example, in a relatively dark environment, relatively low intensity levels are desirable in order to avoid eye strain. Conversely, in a relative bright environment, higher intensity levels are desirable.

Figure 3:
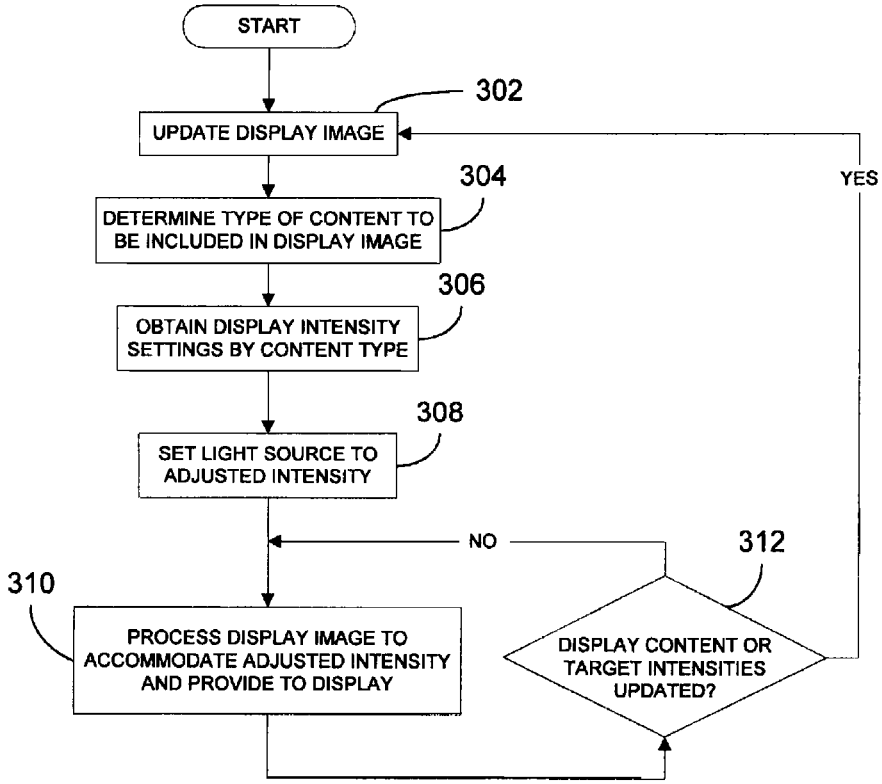
FIG. 3 is a flow chart illustrating processing in accordance with the present invention.

Referring now to FIG. 3, processing in accordance with the present invention is further illustrated. Unless noted otherwise, the processing illustrated in FIG. 3 is preferably implemented using one or more processors operating under the control of executable instructions stored in suitable memory devices, such as those illustrated in FIG. 2. However, as is known to those having ordinary skill in the art, other implementation techniques may be equally employed, such as programmable logic arrays, ASICs, state machines, etc. Referring now to block 302, a display image to be provided to a display is updated, typically by a graphics processor (or whatever component is used to implement the processing of FIG. 3). As known in the art, images provided on a display, such as a computer display, are typically a continuous series of images provided at a rate of anywhere from 24 to 120 times per second. In the case of a computer, for example, a user may take actions that result in different types of content being displayed on the display. Thus, each time a new display image is to be generated, it must first be determined (typically by the graphics processor) what content is to be displayed in the updated display image. This is performed at block 304. Techniques for determining what content is to be included in a given display image, as well as for determining the types of content to be included within that display image, are well known to those having ordinary skill in the art.

At block 306, a plurality of intensity settings based on corresponding plurality of content types are obtained. This may be done to determine if any previously obtained intensity settings and corresponding content types have recently changed. To this end, it is necessary for the processor implementing the processing of FIG. 3 to have first have knowledge that the display is capable of having its light source intensity programmed, as well as the range of available settings. As described above, the display preferably comprises a storage device capable of storing parameters such as an indicator of light source programmability and the range of possible settings through an EDID structure. Mechanisms such as the so-called display data channel (DDC) allow a graphics processor to access data stored in the EDID. Furthermore, in a presently preferred embodiment, the communication path between the graphics processor and the display also allows the graphics processor to control operation of the display including, but not limited to, the ability to control settings of various display parameters. For example, the so-called display data channel command interface (DDC/CI) allows the graphics processor to control display parameters such as brightness and/or light source intensity, color balance, etc. Based on an understanding of the display's capabilities, the processor can obtain the necessary intensity settings based on knowledge (as determined at block 304) of the types of content included in the display image. For example, a table of intensity settings indexed by content type may be pre-stored in memory associated with the host processor or co-processor. Elaborating further, a graphics processor may obtain these parameters from a host processor that, in turn, obtains these parameters from a suitable memory device that has either been preprogrammed at the time of the device configuration, or that is populated in response to user inputs received by the host processor. For example, as known in the art, the host processor can implement an application program to provide a suitable control panel that may be used to obtain user inputs regarding the various relevant parameters. The user inputs received in this manner may thereafter be stored (after any suitable processing, e.g., converting a slider or drop-down menu value to a usable value) in a storage device. In this manner, identities of content can be used to simply look up the necessary intensity settings. An advantage of this approach is that such settings may be updated as necessary or desired without substantial interruption of performance. In another embodiment, although not preferred, the indexed intensity settings may be stored in the display itself (via, for example, an EDID structure). As known to those of skill in the art, such cross-referenced intensity and content type tables may be obtained using still other techniques as a matter of design choice.

Additionally, at block 306, it is determined whether any of the content being included in the updated display image require an adjusted brightness relative to the current settings of the display. In one embodiment of the present invention, this is accomplished by comparing the types of content to be included in the display image against a plurality of content types included in the currently-displayed image. The corresponding intensity settings of any new content types (relative to the currently-displayed image) thus identified are compared to the current intensity setting of the display. If one of the identified intensity settings does not match the current intensity setting, then the corresponding content type requires an adjusted brightness relative to the current intensity setting of the display. The intensity setting necessary to achieve the adjusted brightness is designated as the selected intensity setting.

The plurality of content types described above with reference to block 306 are identifications of different types of content that may contribute to display images to be rendered on the display. As used herein, the term content includes any data or information that may be rendered on a display. For example, video images may comprise one type of content, three dimensional (3D) graphics may comprise another type of content, and document files (such as word processing documents, spreadsheet documents, etc.) may comprise yet another content type. Those having ordinary skill in the art will appreciate that a great number of content types may be similarly defined. For each of the various content types defined, a corresponding intensity setting is likewise defined. As used herein, an intensity setting for a display describes the level of light output by the light source of the display, which in turn effects the perceived brightness or luminance of the display. For example, a given display may be capable of providing an overall brightness in the range of 100-300 nits. Under the control of a configurable parameter, the light source of the display can be operated to provide discrete levels of perceived brightness, such as, by way on non-limiting example, 100, 200, or 300 nits, as desired. Because, as noted previously, various types of content are authored based on certain assumptions regarding the brightness of the display used to render the content, the intensity settings associated with each content type may be used to control operation of the display's light source to best match the brightness of the display to a particular content type.

Regardless of the manner in which the intensity settings are obtained, processing continues at block 308 where the intensity of the light source of the display is set to an adjusted intensity based on the selected intensity setting using, for example, the DDC/CI mechanism described above. Using current technology, it is generally possible to only adjust the intensity for the entire light source of the display. However, it is anticipated that the present invention may also be equally applied to any display that is capable of adjusting intensity of a portion of its light source, e.g., individual light-emitting display elements. Furthermore, the adjustment accomplished at block 308 may take into account the ambient light within the viewing environment, as described above.

The display image is processed to accommodate the adjusted intensity of the display, and the resulting image is provided to the display at block 310. Generally, processing of the image to accommodate the adjusted intensity of the display requires processing that portion of the display image that is unrelated to the content (if any) to account for the adjusted intensity of the light source. For example, where video content is to be displayed as part of the display image, it may be necessary to increase the intensity of the light source. However, those portions of the display image not contributing to the video contents and also not requiring the increased intensity of the light source, must be processed to account for this increase in intensity, i.e., the level of brightness presented by the non-content display portions must be correspondingly dimmed to account for the increased intensity of the light source. The preferred embodiment for this process if further illustrated with reference to FIG. 4.

In particular at block 402, a region of the display image is identified corresponding to the content requiring adjusted brightness. For example, in the case where a graphics processor is used to implement this portion of the present invention, this is a relatively straight forward task to the extent that the graphics processor has knowledge of the precise coordinates defining where the particular content is to be displayed on the display screen. However, the present invention is not limited in this regard, and virtually any input paradigm may be used to ascertain or otherwise define the region within the display image requiring adjusted brightness. Thereafter, at block 404, that portion of the display image other than the region (i.e., the remaining portion of the display image) is processed to accommodate the adjusted brightness required by the region. For example, the gamma correction factor applied to remaining portion could be adjusted to accommodate the adjusted brightness. Alternatively, the "contrast" (i.e., the level of white level brightness) could be modified for the same purpose. Still other techniques may be used as known to those having skill in the art. For example, color tint/hue can be adjusted, or so-called "color temperature" or "white point" parameters may likewise be adjusted. It should also be noted that, as used herein, a region within the display image does not necessarily require a single, contiguous area and, in fact, could comprise multiple areas that are not otherwise continuous. Regardless of the type of processing performed at block 404, the nature or extent of such processing may also take into account the nature of the ambient light in the viewing environment, as described above.

Figure 4:
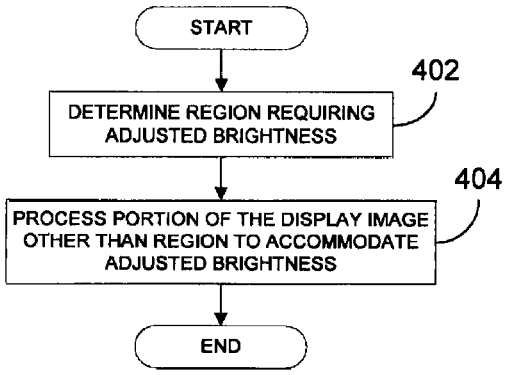
FIG. 4 is a flow chart illustrating processing of one of the blocks of FIG. 3 in greater detail.

Of course, if none of the content to be included in the display image require an adjusted brightness relative to the current settings of the display, the processing described above relative to FIG. 4 is not performed. Regardless of whether the processing of FIG. 4 is performed, the display image is provided to the display in accordance with known techniques. However, when the processing of FIG. 4 is performed, it is preferable that it is performed on the output of an image frame buffer, thereby eliminating the need to store each display image (i.e., frame) twice, once before processing in accordance with FIG. 4 and once after.

Referring once again to FIG. 3, after the display image is provided to the display (with or without processing to account for any adjustments to intensity settings), processing continues at block 312 where it is determined whether the display image needs to be updated or whether the intensity settings and corresponding content types have been updated. Regarding the former, it is possible that the display image may remain static for longer than one or more full image update periods. In this case (and assuming that the intensity settings and corresponding content types have not been updated) processing continues at block 310 as previously described. However, if the display image does require updating, and/or if the intensity settings and corresponding content types have been updated (for example, through the use of a suitable control panel or other user input mechanism), processing continues at block 302 as described above.

Figure 5:
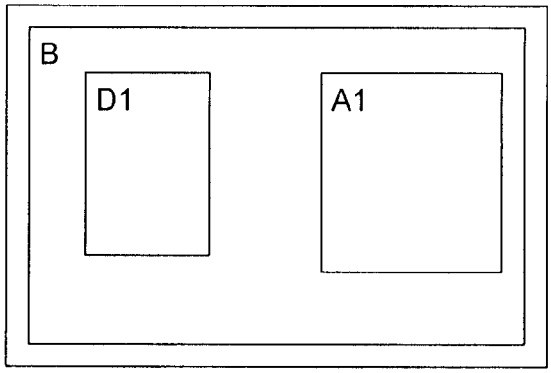
FIGS. 5 through 9 illustrate exemplary display images in accordance with the present invention.

The processing described above may be better understood with further reference to FIGS. 5 through 9. In the examples of FIGS. 5 through 9, it is assumed that the display being used is a computer display having relatively high brightness as described above. In the example of FIG. 5, three separate regions are defined according to the content (or lack thereof) to be displayed within each region. That is, a first region corresponding to a document D1 is provided; a second region corresponding to an application A1 is also provided; and a third region constituting the remaining portion or background B of the display not covered by document D1 and application A1, is provided. If A1, D1 and B are all content viewed with at a relatively low intensity, then initially display light source level is set low to this desired intensity level and no additional processing of the image data itself is needed.

Figure 6:
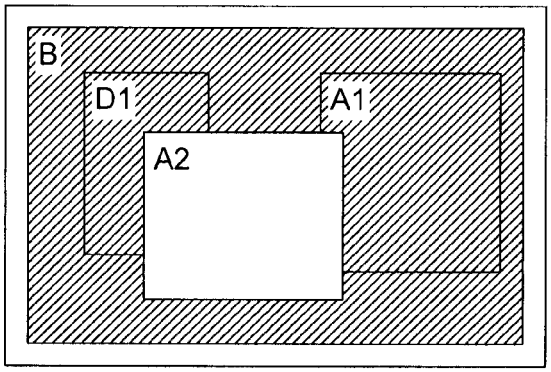

Assuming that a new application A2 is initiated, FIG. 6 illustrates an example of what the resulting display image might look like. Further, it is assumed that the new application A2 requires an adjusted brightness for optimal viewing. For example, it is assumed that the application A2 is displaying video content requiring an increase in intensity of the display's light source. As a result of this addition, that portion of the display image not obscured by the region covered by the new application A2 is thereafter processed to become complementarily dimmer as a result of the increased light source intensity. This is illustrated in FIG. 6 where the visible portions of those regions corresponding to document D1, application A1, and the background B are shown in shaded form. Note the luminous intensity output by the display in the shaded areas of FIG. 6 is approximately the same as in FIG. 5.

Figure 7:
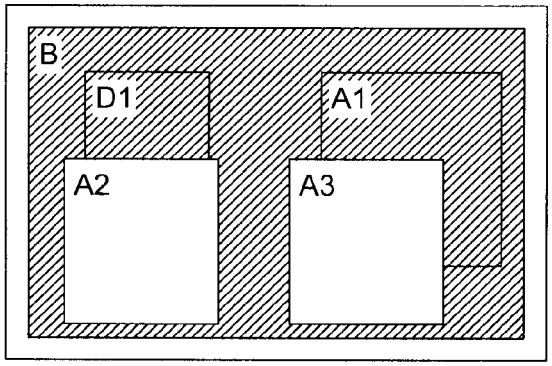
Figure 8:
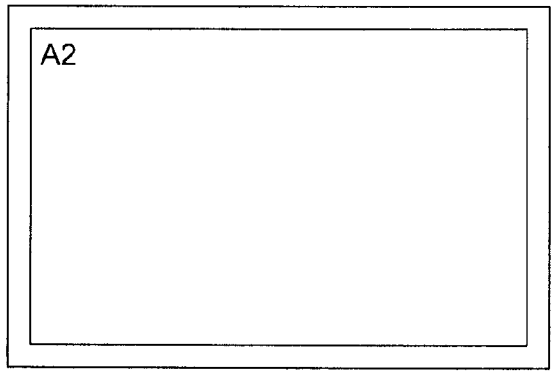
Figure 9:
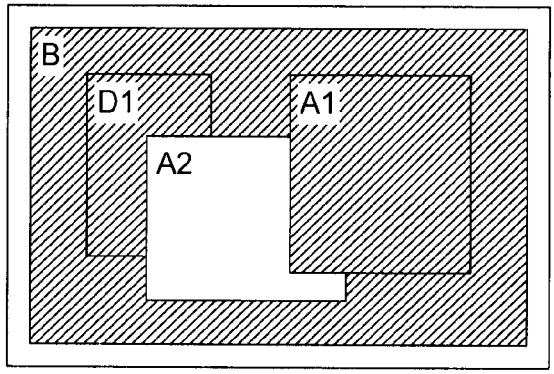

As noted above, it is also possible that the region requiring the adjusted brightness may, in fact, comprise two or more non-contiguous areas, as illustrated in FIG. 7 with applications A2 and A3. In another scenario, illustrated in FIG. 8, it is equally possible that the new application A2 (requiring the adjusted brightness) may, in fact, occupy the entire available area of the display. In this case, it is obviously not necessary to process any portion of the other regions to accommodate for the adjusted intensity of the light source. Further still, as illustrated in FIG. 9, subsequent user operations of the device could cause some, but not all, of the region attributable to the new application A2 to be obscured by one of the other regions not requiring the adjusted brightness. This is illustrated in FIG. 9 where the first application A1 has been selected in such a manner as to partially obscure the region accorded to the new application A2. In effect, this is achieved by increasing that portion of the display image requiring processing to accommodate the increased intensity required for the new application A2.

Figure 10:
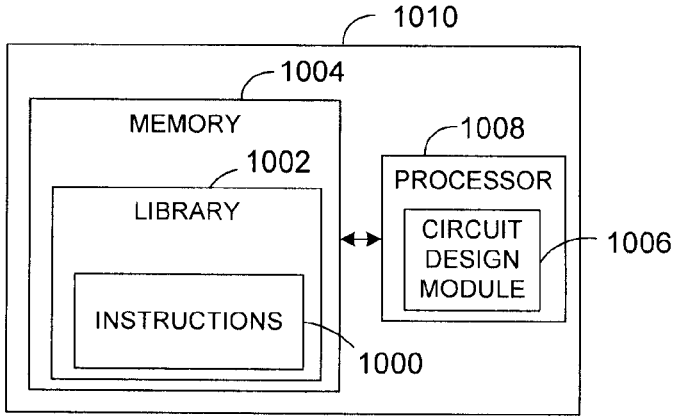
FIG. 10 is an block diagram of an exemplary hardware design that may be used to implement the present invention.

Referring now to FIG. 10, the processing described by the present invention may be embodied in a hardware-based implementation, such as an integrated circuit. To this end, as known by those of skill in the art, a set of executable instruction 1000 may be defined and stored within a library 1002 that, in turn, is stored in memory 1004. The instructions 1000, which may comprise instructions represented in any suitable hardware design language (HDL) including, but not limited to, Verilog or another hardware representation such as GDSII, can be used by a circuit design module 1006 that is executed on a processor 1008 of an integrated circuit design system 1010. Using the instructions 1000, the system 1010 may employed to create a suitable integrated circuit (or other hardware embodiment) capable of performing the processing described herein. Such system 1010 and circuit design module 1006 may be any suitable system and integrated circuit design program as known to those skilled in the art.

As described above, the present invention provides a technique for a processor providing display images to a display to accommodate different types of content having different brightness requirements. This is achieved by the processor determining when content requiring adjusted brightness is shown in the displayed image, setting the intensity level of the display's light source accordingly and processing any remaining portion of the display image to account for the adjusted intensity setting. For at least these reasons, the present invention represents an advancement over prior art techniques.

It is therefore contemplated that the present invention cover any and all modifications, variations or equivalents that fall within the spirit and scope of the basic underlying principles disclosed above and claimed herein.

What is claimed is:

1. In a device comprising a graphics processor in communication with a display, the display having adjustable light source intensity, a method for the graphics processor to adjust brightness of at least a portion of a display image, the method comprising:

determining a type for content to be included in the display image to provide an identified content type, the type being determined according to the manner in which the content is authored for a specific display type;

setting the light source to an adjusted intensity based on the identified content type; and providing the display image to the display having the adjusted intensity.

2. The method of claim 1, wherein setting the light source to the adjusted intensity further comprises selecting the adjusted intensity based in part upon ambient light in a viewing environment of the display.

3. The method of claim 1, wherein providing the display image further comprises:

identifying a region of the display image corresponding to the content and to be displayed at an adjusted brightness, wherein that portion of the display image other than the region constitutes a remaining portion of the display image; and processing the remaining portion of the display image to accommodate the adjusted intensity of the light source.

4. The method of claim 3, wherein processing the remaining portion of the display image further comprises processing the remaining portion of the display image based in part upon ambient light in a viewing environment of the display.

5. The method of claim 1, further comprising:

comparing the identified content type with a plurality of content types; and when the identified content type compares favorably with a matching content type of the plurality of content types, identifying a selected intensity setting of a plurality of intensity settings corresponding to the plurality of content types, the selected intensity setting corresponding to the matching content type, wherein the adjusted intensity is based on the selected intensity setting.

6. The method of claim 5, wherein the device comprises a host processor in communication with the graphics processor and with a storage device, the storage device having stored thereon the plurality of intensity settings and the plurality of content types, the method further comprising:

acquiring, from the host processor, the plurality of intensity settings and the corresponding plurality of content types from the storage device.

7. The method of claim 6, wherein the host processor receives the plurality of intensity settings and the plurality of content types as user input and stores the plurality of intensity settings and the corresponding plurality of content types in the storage device.

8. The method of claim 1, wherein providing the display image to the display further comprises:

processing at least a portion of the display image unrelated to the content to accommodate the adjusted intensity.

9. The method of claim 8, wherein processing the portion of the display image further comprises processing the portion of the display image based in part upon ambient light in a viewing environment of the display.

10. A device comprising at least one processor in communication with a display, the display comprising a light source having adjustable light source intensity, the device further comprising:

a processor-readable medium having stored thereon executable instructions that, when executed by the at least one processor, cause the at least one processor to:

determine a type for content to be included in a display image to provide an identified content type, the type being determined according to the manner in which the content is authored for a specific display type;

set the light source to an adjusted intensity based on the identified content type; and provide the display image to the display having the adjusted intensity.

11. The device of claim 10, further comprising a light sensor in communication with the at least one processor operative to provide ambient light data to the at least one processor, wherein the processor-readable medium further comprises executable instructions that, when executed by the at least one processor, cause the at least one processor to:

select the adjusted intensity based in part upon ambient light in a viewing environment of the display.

12. The device of claim 10, wherein the processor-readable medium further comprises executable instructions that, when executed by the at least one processor, cause the at least one processor to:

identify a region of the display image to be displayed at an adjusted brightness, wherein that portion of the display image other than the region constitutes a remaining portion of the display image; and process the remaining portion of the display image to accommodate the adjusted intensity of the light source.

13. The device of claim 10, wherein the display comprises a storage device having stored thereon a plurality of intensity settings corresponding to a plurality of content types, and wherein the processor-readable medium further comprises executable instructions that, when executed by the at least one processor, cause the at least one processor to:

compare the identified content type with a plurality of content types; and when the identified content type compares favorably with a matching content type of the plurality of content types, identify a selected intensity setting of a plurality of intensity settings corresponding to the plurality of content types, the selected intensity setting corresponding to the matching content type, wherein the adjusted intensity is based on the selected intensity setting.

14. The device of claim 10, wherein the at least one processor comprises a host processor in communication with a graphics processor, wherein the host processor is in communication with a storage device having stored thereon the plurality of intensity settings and the plurality of content types, and wherein the processor-readable medium further comprises executable instructions that, when executed by the graphics processor, cause the graphics processor to:

acquire, from the host processor, the plurality of intensity settings and the corresponding plurality of content types from the storage device.

15. The device of claim 14, further comprising:

a user input device, in communication with the host processor, operative to provide user inputs regarding intensity settings to the host processor, wherein the host processor is further operative to process the user inputs to provide the plurality of intensity settings and the corresponding plurality of content types.

16. The device of claim 10, wherein the processor-readable medium further comprises executable instructions that, when executed by the at least one processor, cause the at least one processor to:

process at least a portion of the display image unrelated to the content to accommodate the adjusted intensity.

17. A non-transitory computer readable medium storing instructions that, when executed, adapt a device to:

determine a type for content to be included in a display image to provide an identified content type, the type being determined according to the manner in which the content is authored for a specific display type;

set a light source of a display having adjustable light source intensity to an adjusted intensity based on the identified content type; and provide the display image to the display having the adjusted intensity.

18. In a device comprising a graphics processor in communication with a display, the display having adjustable light source intensity, a method for the graphics processor to adjust brightness of at least a portion of a display image, the method comprising:

determining a type for content to be included in the display image to provide an identified content type, the type being determined according to the manner in which the content is authored for a specific display type;

setting the light source to an adjusted intensity based on the identified content type;

processing at least a portion of the display image unrelated to the content to accommodate the adjusted intensity; and providing the display image to the display having the adjusted intensity.

* * * * *